US005749187A

United States Patent [19]

Umehara et al.

[11] Patent Number: 5,749,187

[45] Date of Patent: May 12, 1998

[54] PARTITION WALL

[75] Inventors: Kazuyuki Umehara; Masayuki Uchida; Tomoya Hasegawa, all of Tokyo, Japan

[73] Assignee: Yoshino Gypsum Co., Ltd., Tokyo, Japan

[21] Appl. No.: 635,949

[22] PCT Filed: Sep. 4, 1995

[86] PCT No.: PCT/JP95/01754

§ 371 Date: May 1, 1996

§ 102(e) Date: May 1, 1996

[87] PCT Pub. No.: WO96/07800

PCT Pub. Date: Mar. 14, 1996

[30] Foreign Application Priority Data

Sep. 2, 1994 [JP] Japan ..... 6-209881

[51] Int. Cl.[6] ..... E04B 2/28

[52] U.S. Cl. ..... 52/241; 52/265; 52/269; 52/407.3; 52/481.1

[58] Field of Search ..... 52/281, 238.1, 52/239, 242, 481.1, 483.1, 376, 407.3, 265, 267, 268, 269, 241

[56] References Cited

U.S. PATENT DOCUMENTS

| | | | |
|---|---|---|---|
| 3,305,993 | 2/1967 | Nelsson | 52/481.1 |
| 3,559,355 | 2/1971 | Day, Jr. | 52/281 X |
| 3,611,653 | 10/1971 | Zinn | 52/407.3 |
| 4,152,878 | 5/1979 | Balinski | 52/481.1 |
| 4,306,396 | 12/1981 | Iotti | 52/238.1 |
| 4,391,073 | 7/1983 | Mollenkopf et al. | 52/239 X |
| 4,593,508 | 6/1986 | Curatolo | 52/281 X |
| 4,727,692 | 3/1988 | Glockenstein | 52/238.1 X |
| 5,009,043 | 4/1991 | Kurrasch | 52/239 X |
| 5,148,645 | 9/1992 | Lehnert et al. | 52/481.1 X |

FOREIGN PATENT DOCUMENTS

| | | | |
|---|---|---|---|
| 50-33887 | 11/1975 | Japan . | |
| 53-120802 | 9/1978 | Japan . | |
| 53-144120 | 12/1978 | Japan . | |
| 60-10038 | 1/1985 | Japan . | |
| 62-296036 | 12/1987 | Japan . | |
| 6-10004 | 3/1994 | Japan . | |
| 1454841 | 11/1976 | United Kingdom | 52/481.1 |

*Primary Examiner*—Michael Safavi

*Attorney, Agent, or Firm*—Oblon, Spivak, McClelland, Maier & Neustadt, P.C.

[57] ABSTRACT

There is provided a partition wall which is characterized in that studs are secured to upper and lower runners fitted to a substrate in a zigzag arrangement or as common studs; that basic face materials are fitted to the skeleton through sound insulation materials so that the face materials are arranged, in parallel, on both outer sides of the studs, while the studs are internally positioned; and that a hard gypsum sheet comprising fibers dispersed in the gypsum core thereof is arranged on the corresponding outer side of each basic face material. This partition wall is particularly suitable for use as a dry party wall, has satisfactory characteristic properties such as fire protecting properties, sound insulation properties, deformation-follow-up properties, out-of-plane flexural rigidity and hardness. The wall comprises gypsum based construction materials as the top end boards and thus the weight and wall thickness thereof can be reduced.

3 Claims, 2 Drawing Sheets

PARTITION WALL

BACKGROUND OF THE INVENTION

1. Field of the Invention

The present invention relates to a partition wall whose top end board is a hard gypsum sheet as a gypsum based construction material and, in particular, to a dry party wall structure.

2. Discussion of the Background

A gypsum board as a representative of the gypsum based construction material has been used in a variety of applications. The gypsum board is in general a plate-like member comprising a gypsum core which is prepared by kneading hemi-hydrate plaster and water and hardening the mixture and which is covered with base paper, and excellent in, for instance, fire protecting performance, sound insulation properties, installation properties and cost performance. Therefore, it has widely been used as an interior material for buildings. More specifically, it has widely been used as a partition wall, in particular, a dry party wall for high-rise buildings and super high-rise buildings which have recently been popularized rapidly and it has been proved to be excellent in, for instance, aptitude for construction processes, light-weight properties and vibration-follow-up properties.

The dry party wall may separately be set up after the substrate works and during the interior finish works and can be divided into those having a stud structure which are fitted to, for instance, light-weight steel frames (upper and lower runners) secured to the substrate and those having a non-stud structure free of such steel frames. In any case, either of them is completed by locating basic face materials such as reinforced gypsum boards, extrusion molded plates of gypsum and calcium silcate plates, on both sides of each corresponding frame of a substrate, in such a manner that a material having sound insulation properties such as glass wool lies between the face materials; fixing the face materials to the frame by the use of, for instance, tapping screws to form a wall; and then covering the both outer faces of the walls with top end boards through the aid of a paste or optionally simultaneous use of staples, nails or screws.

Such a dry party wall not only serves to separate from a neighboring house, but also has such roles that it can ensure a living environment guaranteeing a comfortable life and that it can protect life and property from disasters (such as a fire). Accordingly, it should satisfy various requirements such as fire protecting properties, sound insulation properties, deformation-follow-up properties, out-of-plane flexural rigidity and hardness. In addition to these required characteristic properties, there has been desired for the redution of the wall thickness and the weight of the dry party wall in order to increase the habitable area as multi-storied and super multi-storied buildings have been popularized.

For this reason, the dry party wall which makes use of a usual gypsum board (having a specific gravity ranging from 0.65 to 0.9) as the top end board is still insufficient in hardness and should further be reduced in the thickness and weight thereof. Accordingly, there has been desired for the development of a partition wall, in particular, a dry party wall structure.

SUMMARY OF THE INVENTION

It is thus an object of the present invention to provide a partition wall, in particular, a dry party wall in which a gypsum based construction material is used as the top end board, which is sufficient in, for instance, fire protecting properties, sound insulation properties, deformation-follow-up properties, out-of-plane flexural rigidity and hardness, which is light weight and whose wall has a reduced thickness.

The present invention has been completed on the basis of the finding that the foregoing problems can effectively be solved by the use of hard gypsum sheets each of which comprises fibers dispersed within a gypsum core thereof, as top end boards for a partition wall, in particular, a dry party wall.

More specifically, the present invention provides a partition wall characterized in that studs are secured to upper and lower runners fitted to a substrate in a zigzag arrangement or as common studs; that basic face materials are fitted to the substrate through sound insulation materials in such a manner that the face materials are arranged, in parallel, on both outer sides of the studs, while the studs are internally positioned; and that each hard gypsum sheet comprising fibers dispersed in the gypsum core thereof is arranged on the corresponding outer side of each basic face material.

The present invention further provides a partition wall characterized in that basic face materials are fitted to both sides of upper and lower runners fitted to a substrate through sound insulation materials in such a manner that the basic face materials face one another in a parallel relation; and that each hard gypsum sheet comprising fibers dispersed in the gypsum core thereof is arranged on the corresponding outer side of each basic face material.

Further, the present invention provides a partition wall characterized in that studs are secured to upper and lower runners fitted to a substrate in a zigzag arrangement or as common studs; and that hard gypsum sheets each comprising fibers dispersed in the gypsum core thereof are arranged, in parallel, on both outer sides of the studs while the studs are internally positioned.

In addition, the present invention also provides a partition wall characterized in that hard gypsum sheets each comprising fibers dispersed in the gypsum core thereof are secured to both sides of upper and lower runners fitted to a substrate through sound insulation materials in such a manner that the hard gypsum sheets face one another in a parallel relation.

DETAILED DESCRIPTION OF THE PREFERRED EMBODIMENTS

Figure 1:
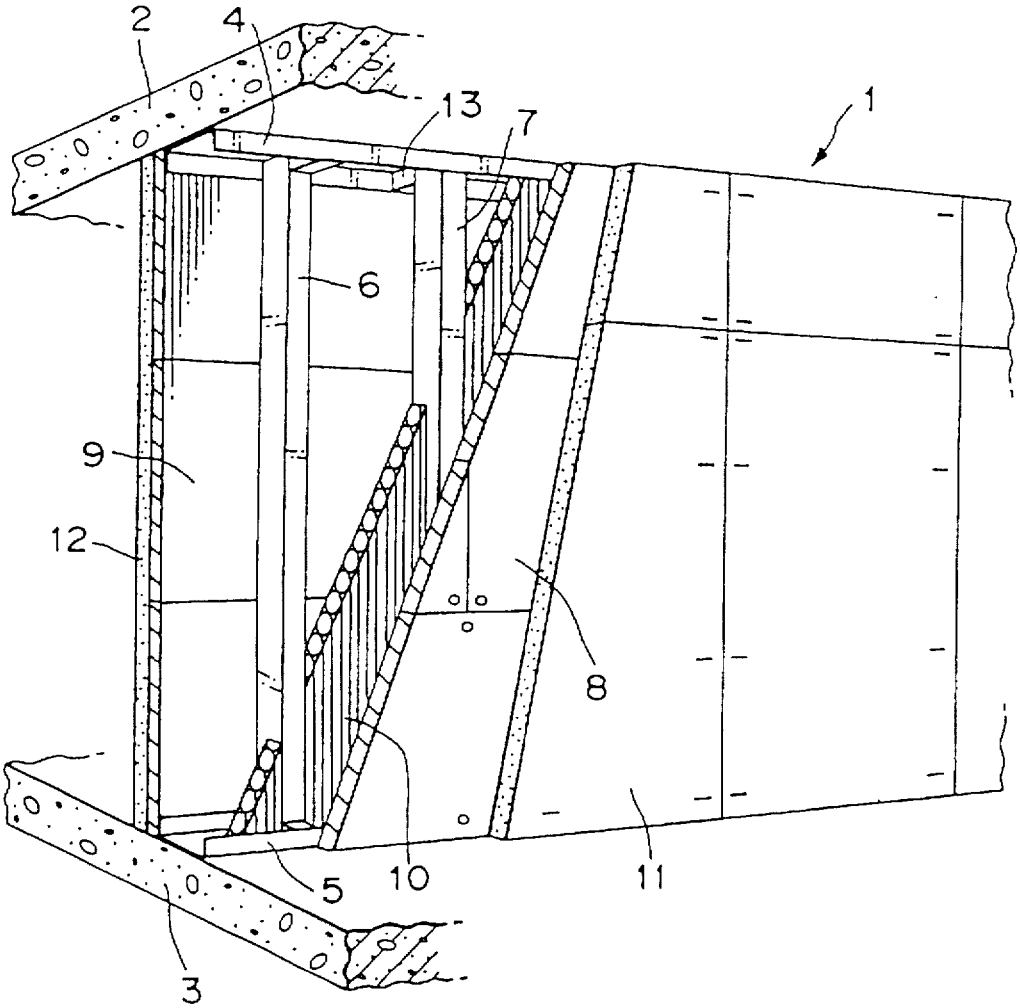
FIG. 1 is a partially sectional view of an embodiment of the dry party wall 1 according to the present invention.

The partition wall of the present invention is particularly suitable for use as a dry party wall and therefore, the present invention will hereinafter be described with the dry party wall taken as an example.

It is preferable that the hard gypsum sheet comprising fibers dispersed in the gypsum core thereof used in the present invention comprise a gypsum core in which fibers are dispersed in an amount ranging from 0.5 to 5 parts by weight per 100 parts by weight of hemi-hydrate plaster and base paper which covers the gypsum core and have a specific gravity ranging from 1 to 1.6. Such a hard gypsum sheet is described in the specification of Japanese Patent Application No. Hei. 6-174306, the disclosure of which is incorporated herein by reference. Specifically, the hard gypsum sheet can easily be prepared by mixing and stirring hemi-hydrate plaster, 0.5 to 5 parts by weight of fibers and 30 to 65% by weight of mixing water per 100 parts by weight of the plaster to thus give a slip and then molding the slip into a plate-like shape through casting it between two sheets of base paper. The fibers used herein may be organic and inorganic fibers or mixture thereof, with the simultaneous use of organic and inorganic fibers being particularly preferred. Examples of inorganic fibers include rock wool, mineral fibers such as asbestos and fibers of sepiolite, glass fibers and carbon fibers. Various kinds of organic fibers may be used, but the use of pulp fibers, in particular, those obtained by beating waste paper is preferred. In order to improve the dispersibility of these fibers in the gypsum core, it is preferred to coat the surface of the fibers with hemi-hydrate plaster by previously admixing the fibers therewith, or to feed the fibers to a kneading machine such as a mixer for kneading them together with, for instance, hemi-hydrate plaster and water after a surface-treatment thereof with, for instance, polyethylene oxide which can impart convergence to the fibers and ensure dispersibility thereof when coming in contact with water. In particular, an amount of these fibers to be added to the core desirably ranges from 1 to 2 parts by weight per 100 parts by weight of the hemi-hydrate plaster. The fibers are preferably those having a shape whose diameter ranges from 5 to 50μ and whose length ranges from 3 to 12 mm from the viewpoint of the quality of the resulting product and the productivity, in particular, those having a diameter ranging from 10 to 20μ and a length ranging from 3 to 6 mm. Moreover, the fibers may have net (or lattice)-like structures. In this case, the fibers having such a net-like structure may be positioned on the surface and/or inside of the hard gypsum sheet when molding the sheet.

When simultaneously using inorganic and organic fibers, the ratio (weight basis) of the former to the latter preferably ranges from 1:0.05 to 1:1. Moreover, an amount of the organic fibers to be used is preferably at highest 2.5 parts by weight per 100 parts by weight of the hemi-hydrate plaster. This is because if the amount of the organic fibers exceeds the upper limit, the casting properties of the slip would be impaired, which is not preferable for the productivity.

The base paper used for covering the gypsum core may be those usually having a basis weight ranging from 150 to 300 $g/m^2$ and conventionally used for preparing gypsum boards. In particular, the use of base paper having high surface hardness permits the production of a hard gypsum sheet having improved surface hardness in addition to high hardness of the hard gypsum core per se.

The specific gravity of the hard gypsum sheet ranges from 1 to 1.6, preferably 1.1 to 1.4 and more preferably 1.2 to 1.4. If the specific gravity thereof exceeds 1.6, the hard gypsum sheet develops a harmful crack when nailing the gypsum sheet on a substrate and accordingly, the hard gypsum sheet cannot be secured to the substrate and the sheet per se is curved depending on the strength of the fixing means such as a nail and this in turn makes the fixing of the sheet impossible. The hard gypsum sheet may comprise, for instance, an adhesive such as starch and/or a hardening accelerator conventionally used, from the viewpoint of the quality of the resulting sheet and the production efficiency thereof.

Figure 2:
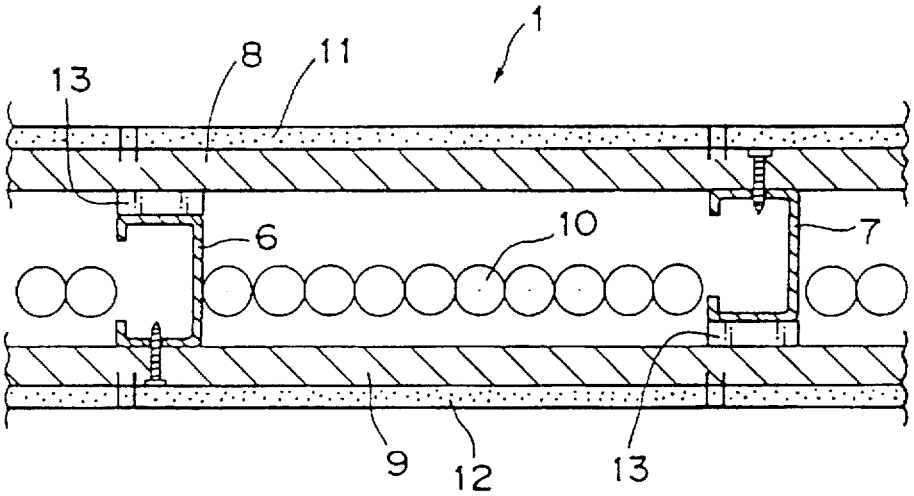
FIG. 2 is a transverse cross-sectional view of the dry party wall shown in FIG. 1. In these figures, reference numerals 2 and 3 represent a substrate; 4 an upper runner; 5 a lower runner; 6 and 7 studs; 8 and 9 basic face materials; 10 a sound insulation material; and 11 and 12 hard gypsum sheets.

The present invention will now be described with reference to the attached drawings, wherein FIG. 1 is a partial cross-sectional view of an embodiment of the dry party wall according to the present invention and FIG. 2 is a transverse cross-sectional view of the dry party wall shown in FIG. 1. As shown in these figures, studs 6 and 7 are secured, in a zigzag arrangement, to an upper runner 4 and a lower runner 5 which are fitted and nailed (with, for instance, concrete nails) to substrates 2 and 3, basic face materials 8 and 9 are secured, in parallel, to both outer sides of the studs 6 and 7 through sound insulation materials 10 with the use of, for instance, tapping screws while the studs 6 and 7 are positioned within the wall 1 and hard gypsum sheets 11 and 12 comprising fibers dispersed in the gypsum core thereof are fixed to the outer sides of the corresponding basic face materials 8 and 9 with the use of, for instance, a staple or an adhesive. Moreover, a spacer 13 may be arranged in a gap between the upper and lower runners 4 and 5 and the studs 6 and 7.

In this structure, the upper and lower runners 4 and 5 may be light weight steel frames (such as a C-shaped channel steel) or wood, while the studs 6, 7 may be light weight steel frames (such as a C-shaped channel steel) or wood, having a width ranging from 45 to 100 mm and a thickness ranging from 0.5 to 3.2 mm. In addition, the basic face materials 8, 9 may be reinforced gypsum boards, extrusion-molded gypsum plates and calcium silicate plates. Moreover, the sound insulation material 10 may be, for instance, glass wool and rock wool. The hard gypsum sheets 11, 12 used herein are preferably those having a thickness ranging from 9.5 to 25 mm. The thickness of the finally constructed dry party wall may arbitrarily be selected, but preferably ranges from 120 to 270 mm to effectively ensure the foregoing characteristic properties to be imparted to the wall and more preferably not less than 140 mm from the viewpoint of ensuring high sound insulation properties. The wall may further be subjected to joint finishing and facing processes for the hard gypsum sheets.

Alternatively, the dry party wall of the present invention may likewise be constructed by directly securing, through the sound insulation materials 10, the basic face materials 8 and 9 to the upper and lower runners 4 and 5 fitted to the substrates 2 and 3 without using any stud 6, 7, in such a manner that the sound insulation materials 10 face one another in a parallel relation and fixing the hard gypsum sheets 11, 12 each comprising fibers dispersed in the gypsum core thereof to the outer sides of the corresponding basic face materials 8, 9 through, for instance, an adhesive layer. Moreover, the dry party wall of the present invention may also be constructed in such a manner that the studs 6, 7 are secured to the upper and lower runners 4, 5 fixed to the substrates 2, 3 in a zigzag arrangement or as common studs and that the hard gypsum sheets 11, 12 each comprising fibers dispersed in the gypsum core thereof are directly fixed, in parallel, to the both outer sides of the studs 6, 7 through, for instance, an adhesive layer without using any basic face material, while the studs 6, 7 are positioned within the wall.

Furthermore, the dry party wall of the present invention may be designed to have such a simple structure that the hard gypsum sheets 11, 12 each comprising fibers dispersed in the gypsum core thereof are directly fitted to the both sides of the upper and lower runners 4, 5 fixed to the substrates 2, 3 through the sound insulation materials 10 without using any basic face material, while the hard gypsum sheets face one another in a parallel relation.

According to the present invention, there can be provided a light weight and thin partition wall, in particular, a dry party wall which possesses satisfactory properties such as fire protecting properties, sound insulation properties, deformation-follow-up properties, out-of-plane flexural rigidity and hardness. In addition, the dry partition wall can be used not only as the party walls, but also as the usual partition walls. Moreover, it is a matter of course that the wall of the present invention can be used as party walls and partition walls for low-rise buildings.

The present invention will now be described with reference to the following Examples.

EXAMPLE 1

A dry party wall shown in FIGS. 1 and 2 was constructed according to the following procedures. First, upper and lower runners 4 and 5 were fixed to substrates 2, 3 such as ceiling slabs or floor slabs using, for instance, concrete nails having a size of 4 mmϕ×3 mm. Studs 6, 7 were then secured to the upper and lower runners 4 and 5 in a zigzag arrangement. A basic face material 8 (a reinforced gypsum board having a thickness of 21 mm and a specific density of 0.775) was fitted to one outer side of the studs 6, 7 using screws or nails so that the studs 6, 7 were positioned within the wall, sound insulation materials 10 (glass wool having a basis weight of 24/m$^3$ and a thickness of 25 mm) were inserted and a basic face material 9 produced from the same material used for forming the material 8 was secured to the opposite side of the studs 6, 7 using screws or nails, such that it is parallel with the face material 8. Then hard gypsum sheets 11 and 12 were fixed to both outer sides of the basic face materials 8, 9 using a staple and a paste (a vinyl acetate adhesive) to thus complete a dry party wall. The dry party wall thus constructed had a wall thickness of 132 mm and a surface density of 65 kg/m$^2$ .

The hard gypsum sheets 11 and 12 were prepared by the following method and had a thickness of 12.5 mm and a specific gravity of 1.3.

A slip (a gypsum slurry) was prepared by blending, in a mixer, 3.0 kg of α-hemihydrate gypsum, 7.0 kg of β-hemihydrate gypsum, 73 liters of mixing water, 60 g of a melamine water reducing agent and 100 g of glass fibers having a diameter of 20μ and a length of 3.3 mm, then casting the slip between two sheets of base paper (commonly used in gypsum boards having a basis weight of 250 g/m$^2$), passing through molding rolls to give a hard gypsum sheet and then drying the sheet.

Comparative Example 1

A dry party wall having a wall thickness of 149 mm and a surface density of 65 kg/m$^2$ was assembled by repeating the same procedures used in Example 1 except that reinforced gypsum boards each having a thickness of 21 mm and a specific gravity of 0.775 were substituted for the hard gypsum sheets 11 and 12.

Characteristic properties of the dry party walls produced in Example 1 and Comparative Example 1 were evaluated according to the following methods.

Test Methods

Test of Fire Protecting Properties: This test was carried out in accordance with the "Method of Fire Resistance Test for Structural Parts of Buildings" as specified in JIS A 1304.

Deformation-Follow-Up Properties: This was determined by giving a displacement of 1/200 to each party wall, determining a displacement at each measured point under the influence of the given displacement and observing the condition of the surface thereof, according to the "Deformability Test by In-Plane Shearing of Assembled Panel for Non-Proof-Stress" as specified in JIS A 1414 6.18.

Out-Of-Plane Flexural Rigidity: This was determined by horizontally pressing each specimen under a load of 180 kg, determining the displacement in response to the pressing and observing the condition of the specimen, according to the Better Living (Foundation) Interior System Testing Method: "Distributed Pressure Intensity Test".

Surface Hardness (Impact Strength): A steel ball of 1 kg was dropped on each specimen from a fixed height of 1 m and the depth of the depression formed on the surface thereof is determined.

Sound Insulation Properties: This was determined according to the "Method for Laboratory Measurement of Sound Transmission Loss" as specified in JIS A 1416.

The results thus obtained are summarized in the following Table

TABLE 1

| | Sample of the Invention | Comparative Example 1 |
|---|---|---|
| Sound Insulation Properties | TLp 57 | TLp 52 |
| Fire Protecting Properties | 2 hours | 2 hours |
| Out-Of-Plane Flexural Rigidity | 180 kgf | 180 kgf |
| | 5 mm | 7 mm |
| Hardness | 0.7 mm | 1.0 mm |
| Deformation-Follow-Up Properties | Normal | Normal |

As seen from the results listed in Table 1, the comparison of these results while setting the surface density at the same level and changing the wall thickness makes it clear that the product of the present invention is excellent in sound insulation properties, out-of-plane flexural rigidity and hardness, as compared with the product of Comparative Example, although the wall of the former is thinner than that of the latter.

A dry party wall having the structure used in comparative example should have a wall thickness of 157 mm and a surface density of 75.6 kg/m$^2$ in order to achieve the same level of sound insulation properties as those observed for the product of the present invention.

We claim:

1. A partition wall comprising:

a first substrate with an upper runner;

a second substrate with a lower runner;

basic face materials which are fitted to both the upper runner and the lower runner through sound insulation materials so that said basic face materials face one another in parallel relation;

studs secured to the upper runner and the lower runner, said studs being located between the basic face materials; and hard gypsum sheets arranged on an outer side of each of said basic face materials, wherein said hard gypsum sheets comprise a gypsum core containing 0.5 to 5 parts by weight of dispersed fibers per 100 parts by weight of hemi-hydrate plaster and a base paper covering the gypsum core, and have a specific gravity ranging from 1 to 1.6, and wherein the studs are fitted to the basic face materials in a zigzag arrangement.

2. A partition wall comprising:

an upper runner attached to a first substrate;

a lower runner attached to a second substrate;

first and second basic face materials which are fitted to the upper runner and the lower runner through sound insulating materials so that the first and second basic face materials face one another in parallel relation;

studs secured to the upper and lower runners, said studs being located between the first and second basic face materials and each of said studs being alternately attached to the first basic face material and the second basic face material; and first and second hard gypsum sheets arranged on an outer side of each of said first and second basic face materials, wherein each of the first and second hard gypsum sheets comprises a gypsum core containing 0.5 to 5 parts by weight of dispersed fibers per 100 parts by weight of hemi-hydrate plaster and a base paper covering the gypsum core, and has a specific gravity ranging from 1 to 1.6.

3. The partition wall as in one of claims 1 or 2, wherein the partition wall is used as a dry party wall.

* * * * *